US007086958B2

(12) United States Patent
Eigiro

(10) Patent No.: US 7,086,958 B2
(45) Date of Patent: Aug. 8, 2006

(54) POSTURE CORRECTING TOOL

(76) Inventor: Tomomori Eigiro, 7-8-2-516, Funabashi, Setagaya-ku, Tokyo (JP)

( * ) Notice: Subject to any disclaimer, the term of this patent is extended or adjusted under 35 U.S.C. 154(b) by 0 days.

(21) Appl. No.: 11/214,024

(22) Filed: Aug. 30, 2005

(65) Prior Publication Data

US 2006/0046865 A1 Mar. 2, 2006

(30) Foreign Application Priority Data

Aug. 31, 2004 (JP) ..... 2004-252165

(51) Int. Cl.
*A63B 69/36* (2006.01)

(52) U.S. Cl. ..... 473/266; 473/215; 602/19; 434/252

(58) Field of Classification Search ..... 473/266, 473/269, 274, 275, 276, 277, 215; 602/17, 602/18, 19; 434/247
See application file for complete search history.

(56) References Cited

U.S. PATENT DOCUMENTS 4,958,145 A * 9/1990 Morris ..... 340/689
5,868,691 A * 2/1999 Vishnevsky ..... 602/19
5,876,361 A * 3/1999 Harris ..... 602/19
6,461,256 B1 * 10/2002 Popeck ..... 473/450
6,719,640 B1 * 4/2004 Madole ..... 473/215

FOREIGN PATENT DOCUMENTS

JP 07-284548 10/1995

* cited by examiner

*Primary Examiner*—Nini F. Legesse
(74) *Attorney, Agent, or Firm*—Arent Fox PLLC

(57) ABSTRACT

A posture correcting tool is provided which allows a golf player to practice so that the forward inclination angle of the upper-half body when impacting on a ball with a club can be controlled appropriately and extend the ball flight distance. Being a posture correcting tool worn by a player when practicing club swings, it has a wearing unit which can be fixed to the player's waist, a back fitting unit which is rotatably joined with the wearing unit, arranged so that it can fit with the player's back when worn, and can regulate the forward inclination angle of the upper-half body when the player swings a golf club, and an angle indicating unit with which the forward inclination angle can be visually checked.

8 Claims, 2 Drawing Sheets

POSTURE CORRECTING TOOL

BACKGROUND OF THE INVENTION

The present invention relates to a posture correcting tool, especially a posture correcting tool for optimizing forward-inclined posture when a golf player impacts on a ball.

In order for a golf player to extend the ball flight distance when impacting a ball with a club, an appropriate swing of the golf club needs to be performed. The inventor of the invention of the present patent application has confirmed through many years of his experience in golf coaching that in this case the distance between the ball and legs needs to be optimized, and the forward-inclined posture of the upper-half of the body when the club impacts on the ball needs to be optimized in order to perform an appropriate swing.

Namely, in order to extend the ball flight distance more precisely, kinetic energy produced by the horizontal rotation of the body such as twisting the waist and the vertical rotation of swinging the arm and the club needs to be transmitted most efficiently to the ball via the golf club.

In order to transmit the generated energy most efficiently from the club to the ball, it is the most important to set the forward inclination angle of the upper-half body to a certain degree.

The inventor of the invention of the present patent application has grasped through his many years of experience in golf coaching that the optimal forward inclination angle in this case is 30~35 degrees with the waist as the base point relative to a vertical axis line passing the waist.

Note that in order to transmit kinetic energy from the club to the ball without loss, it eventually becomes necessary to fine tune the position of the club grip and fix it so that the head forms the optimal impact face.

However, because the forward inclination angle of the upper-half body inevitably varies delicately due to the place where the player plays, the player's health condition, time-wise condition such as whether it is at the beginning of the play or after a certain time passed, etc., constantly maintaining an appropriate forward inclination angle has been extremely difficult, irrespective of whether the player is an amateur or a professional.

This point is also evident from the fact that the reason professional golf players show scattered scores in the latter half of tournaments is that the players themselves cannot check the forward-inclined posture.

Hence, in order to constantly maintain the forward-inclined posture of the upper-half body, repeated practice is necessary under a condition where the forward-inclined posture is maintained at a constant angle while practicing. However, there has been the difficulty of having an awareness of the forward inclination angle in order for the player himself to maintain the forward-inclined posture.

Conventionally, publicized by JP H07-284548 is a golf swing axis training tool for learning the swing method for twisting the body with the backbone as its axis and the optimal angle of the upper-half body.

Said golf swing axis training tool comprises a waist belt attached to the player's waist, a contact belt which is placed along the player's backbone and is rotatably attached to the waist belt in the plane intersecting the waist belt perpendicular to the waist belt, and an angle adjusting means which adjusts the angle between the contact member and waist belt in order to optimally maintain the angle between the player's backbone and waist.

Then, the golf swing axis training tool adjusts the angle between the waist belt and the contact member by the angle adjusting means and senses whether the angle between the backbone and the waist is ideal or not by the sense of the contact member contacting with the back.

As described in the Specification, the golf swing axis training tool is constituted so that after it is worn on the body, the player can halt the upper-half body at an ideal posture which is the state for addressing or impacting a ball wherein the upper-half body is most bent relative to the waist, adjusting the nut tightening force to such a degree that almost the whole contact member slightly contacts with the back, and then fixing the nut, by which the player can always optimally maintain the angle between his backbone and waist when addressing the ball.

However, this kind of conventional golf swing axis training tool is constituted only for bending the upper-half body at the most bent position relative to the waist and practicing swings in this state. It is not made from the viewpoint of considering an angle of 30~35 degrees centering the hip joint which is the forward inclination angle for most efficiently transmitting the energy generated by twisting the body in the horizontal and vertical directions to the ball and practicing so as to maintaining that forward inclination angle as stated above.

Hence, there has been the problem that even when practice is performed using such a conventional golf swing axis training tool, the ball flight distance could not be extended.

Also, there was the inconvenience that after adjusting the angle by an angle adjusting means by wearing it on the body in practicing, the player had to always maintain the forward-inclined posture and could not extend the upper-half body, feeling very tight, and thus the wearing feeling was not good.

SUMMARY OF THE INVENTION

The objective of the present invention is to provide a posture correcting tool with which the forward inclination angle of the player's upper-half body when he impacts on a ball with a club can be adequately controlled to practice more precisely for extending the ball flight distance.

In order to solve the problem, the posture correcting tool is constituted such that being a posture correcting tool worn when a player performs swing practices, it has a wearing unit which can be fixed to the player's waist, a back fitting unit which is fixed to the wearing unit, is arranged so that it can fit with the player's back when it is worm, and can regulate the forward inclination angle of the upper-half body when the player swings, and an angle indicating unit against which the forward inclination angle can be visually checked.

Also, the posture correcting tool of the present invention is constituted such that being a posture correcting tool worn when a player practices golf club swings, it has a wearing unit which can be fixed to the player's waist, a back fitting unit which is fixed to the wearing unit, is arranged to fit with the player's back when it is worn, and can regulate the forward inclination angle of the upper-half body when the player swings a golf club, and an angle indicating unit with which the forward inclination angle can be visually checked.

Namely, the posture correcting tool of the present invention is constituted in such a way that it is fixed to a player's waist using the wearing unit and the back fitting unit fits with the player's back so that the forward inclination angle of the upper-half body of the player when he swings a golf club can be regulated in a state where it can be visually checked as an accurate numerical value.

Also, the posture correcting tool of the present invention is constituted such that it is constituted so that the specified forward inclination angle of the upper-half body of a player can be regulated so that the player can transmit kinetic energy most efficiently to a ball when his golf club impacts on the ball.

Namely, in the posture correcting tool of the present invention, the back fitting unit regulates the forward inclination angle of the player's upper-half body so that kinetic energy can be transmitted to a ball most efficiently when the golf club impacts on the ball.

Hence, the player can learn the forward inclination angle of the upper-half body which can transmit energy most efficiently by repeatedly practicing swings in the state of maintaining the optimal forward inclination angle of the upper-half body.

Also, the posture correcting tool of the present invention is constituted such that the wearing unit has locking pieces which can grab the players waist, the back fitting unit has a regulating piece which is fixed at about the right angle to the locking pieces and can fit with the player's back along the height direction of his back, and the angle indicating unit has an angle indicating piece which protrudes widthwise to the regulating piece, and an angle indicating bar which is rotatably fixed to the end of the locking pieces and can display an angle on the angle indicating piece.

Namely, the posture correcting tool of the present invention is worn by the locking pieces of the wearing unit grabbing the player's waist, and regulates the optimal forward inclination angle of the player's upper-half body by the regulating piece of the back fitting unit fitting with the player's back along the height direction of his back.

In this case, because the regulating piece is fixed at about the right angle to the locking pieces, the regulating piece as the whole fits with the back in the state where the regulating piece runs along the back surface. Also, the angle indicating unit is constituted so that the angle indicating bar display the optimal forward inclination angle of the player's upper-half body on the angle indicating piece.

Also, in the posture correcting tool of the present invention, the locking pieces are formed with a right-and-left pair of curved elastic pieces, the regulating piece being equipped with a back fitting face which fits with the player's back, and the angle indicating piece comprises an arc-shape member which is formed curved and installed on the opposite back fitting face of the regulating piece.

Namely, in the posture correcting tool of the present invention, the locking pieces of the wearing unit are formed with a right-and-left pair of curved elastic pieces, by which the player can wear the wearing unit securely by the right-and-left pair of elastic pieces grabbing the outer faces of the waist. Also, while a back fitting face which fits with the player's back is formed on one face of the regulating piece of the back fitting unit, a curved arc-shape member is installed on the opposing face, and this arc-shape member is formed as the angle indicating piece in the angle indicating unit.

Also, the posture correcting tool of the present invention is constituted such that the forward inclination angle is 30~35 degrees centering the hip joint relative to a vertical axis line passing the waist.

Hence, in the invention, a player who wears the posture correcting tool of the present invention has his upper-half body regulated to be inclined by 30~35 degrees centering the hip joint relative to a vertical axis line passing the waist and thus can practice swings by maintaining such a posture that can efficiently transmit kinetic energy of the body in swinging to the club.

Namely, in practicing swings, when the waist is dropped over both legs and the upper-half body is inclined forward by 30~35 degrees centering the hip joint relative to a vertical axis line passing the waist, a line connecting the shoulder blade, the knee, and the backside of the big toe is formed, and when a swing is performed in this state, a posture is secured which can most efficiently transmit kinetic energy produced by twisting the body in the back swing to the ball.

Also, the forward inclination angle can be adjusted according to the player's built within a range which does not influence the effect if it is between 30 and 35 degrees.

In the posture correcting tool of the present invention, because a player can practice swings wearing it in the state where the optimal forward inclination angle is set according to the angle indicating unit, by repeating swing practices while wearing it, he can securely master the forward inclination angle of the upper body which is necessary for extending the flight distance of the golf ball more precisely.

Hence, the invention can be applied to not only golf club swing but also tennis racket swing and further baseball bat swing and hockey club swing.

Also, because the player's upper-half body is not completely restricted by the back fitting unit but the upper-half body can also be raised if necessary in the worn state, there is no problem that the posture becomes painful by being completely restricted by wearing it as in the conventional case.

In the posture correcting tool of the present invention, because a golf player can practice swings wearing it in the state where the optimal forward inclination angle is set according to the angle indicating unit, by repeating golf swing practices while wearing it, he can securely master the forward inclination angle of the upper body which is necessary for extending the flight distance of the golf ball more precisely.

Also, because the player's upper-half body is not completely restricted by the back fitting unit but the upper-half body can also be raised if necessary in the worn state, there is no problem that the posture becomes painful by being completely restricted by wearing it as in the conventional case.

Also, in the posture correcting tool of the present invention, because the back fitting unit is constituted so that it can regulate the specified forward inclination angle of the upper-half body of the player which is required for extending the flight distance of the golf ball more precisely, the player can swing at a posture wherein the upper-half body is inclined forward by the specified angle required for extending the ball flight distance more precisely.

Hence, if the player repeats the practice wearing the posture correcting tool, his body becomes accustomed to the forward-inclined posture, and he naturally and easily becomes able to swing at the forward inclination angle even when the posture correcting tool is not worn, extending the ball flight distance more precisely.

Also, in the posture correcting tool of the present invention, when a player wears it and performs club swings, he decides the swing practice posture by adjusting the angle indicating bar to the angle position of forward-inclined posture which can transmit kinetic energy effectively to the ball by rotating the angle indicating bar, checking that angle with the angle indicating bar and wearing it on the body, and controlling the upper-half body so that the angle indicating bar can form a vertical axis passing the waist.

By repeating swings in this state and paying attention lest the angle indicating bar leave the vertical axis, it becomes possible to let the body remember the optimal forward inclination angle of the upper-half body easily.

Also, in the posture correcting tool of the present invention, because the locking pieces are formed with a right-and-left pair of curved elastic pieces, the player can easily and quickly wear the posture correcting tool of the present invention or remove it from the body.

Also, in the posture correcting tool of the present invention, if the forward inclination angle is set appropriately according to the built of the player individual between 30 and 35 degrees centering on the hip joint, a posture can be formed which can transmit kinetic energy of the body, from the club to the ball without loss.

Hence, in the present invention, a forward-inclined posture which can most efficiently transmit kinetic energy of the body to the ball can be mastered easily and securely without using a posture correcting tool by repeated practices.

DESCRIPTION OF THE PREFERRED EMBODIMENTS

A preferred embodiment of the present invention is explained hereafter, with reference to the drawings.

Figure 1:
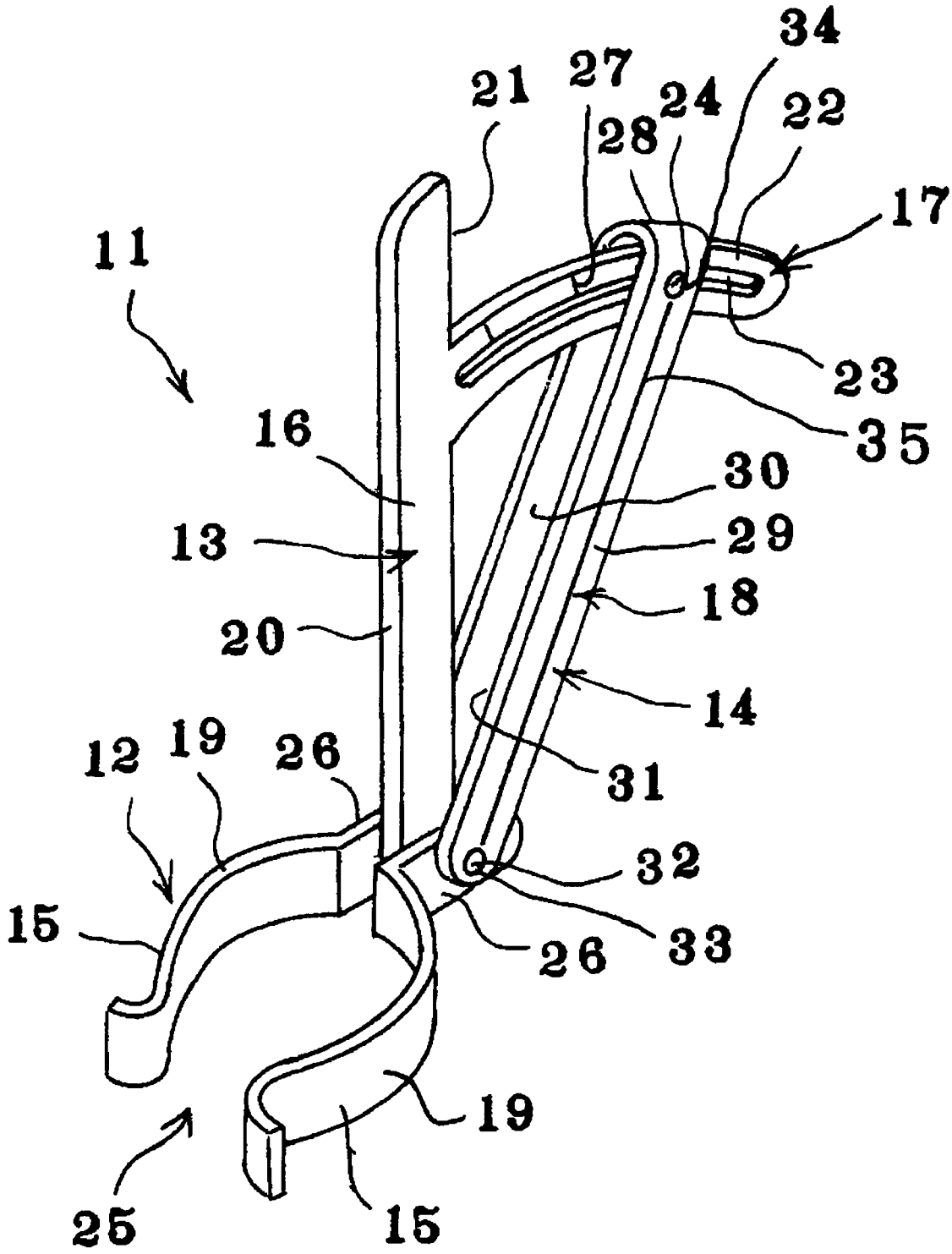
FIG. 1 is an oblique view of an embodiment form showing the posture correcting tool of the present invention.
Figure 2:
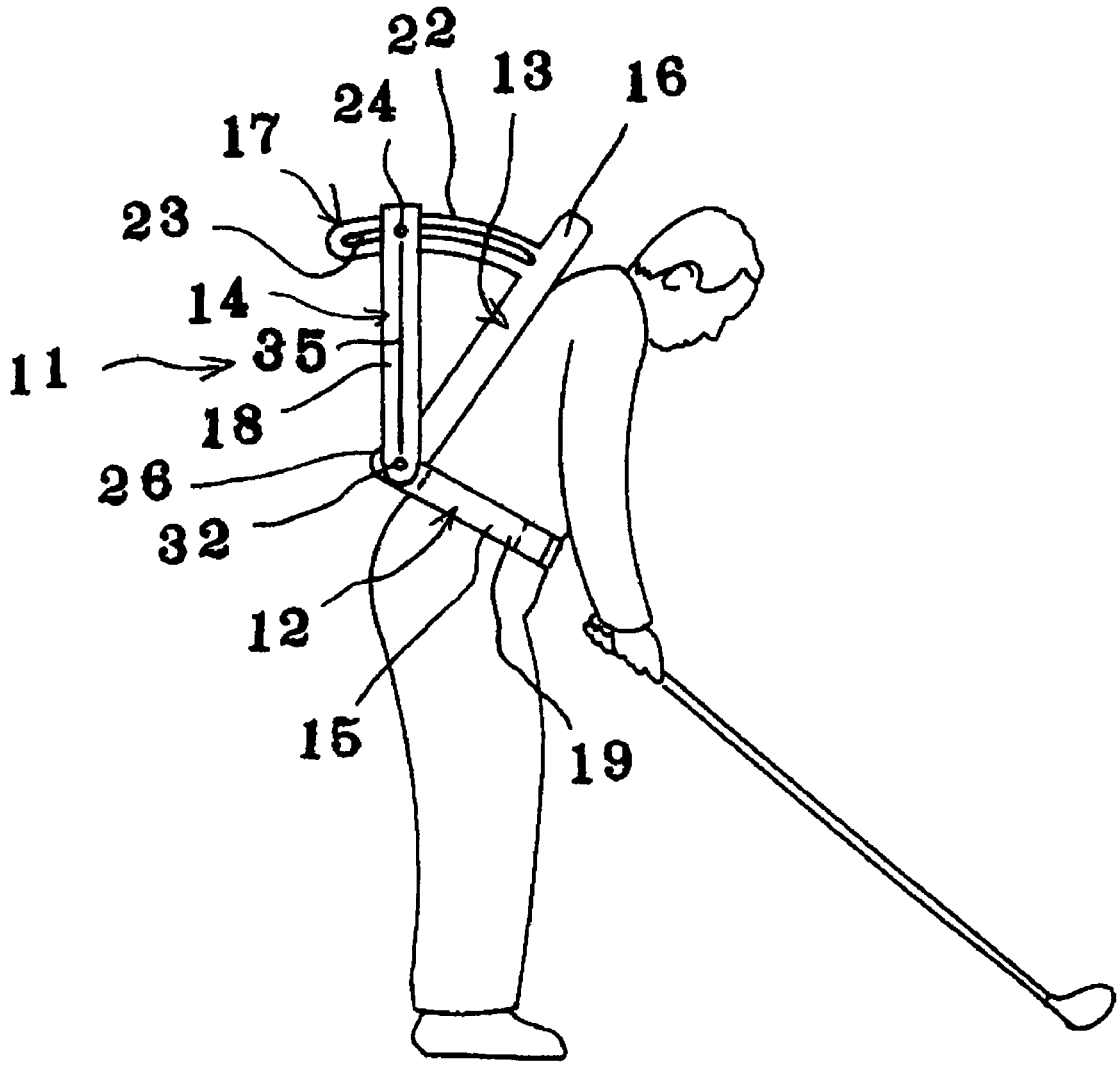
FIG. 2 is a side view showing the state wherein the posture correcting tool of the present invention is used.

As shown in FIG. 1 and FIG. 2, the posture correcting tool 11 of the present invention is a posture correcting tool a player wears when performing golf club swings and is constituted having a wearing unit 12 which can be fixed to the player's waist, a back fitting unit 13 which is rotatably joined to the wearing unit 12, arranged to fit with the player's back when worn, and can regulate the forward inclination angle of the upper-half body when the player swings a golf club, and an angle indicating unit 14 with which the forward inclination angle can be visually checked.

Also, as shown in FIG. 2, the back fitting unit 13 is constituted in such a manner that a specified forward inclination angle of the player's upper-half body can be regulated so that kinetic energy can be most efficiently transmitted to the ball when the golf club impacts on the ball.

Also, as shown in FIG. 1 and FIG. 2, the wearing unit 12 has a pair of locking pieces 15 which can grab the player's waist, the back fitting unit 13 has a regulating piece 16 which is fixed at about the right angle to the locking pieces 15 and can fit with the player's back along it height direction, and the angle indicating unit 14 has an angle indicating piece 17 protruding to the regulating piece 16 along the width direction, and an angle indicating bar 18 which is rotatably fixed to the end of the locking pieces 15 and can display an angle on the angle indicating piece 17.

Also, as shown in FIG. 1 and FIG. 2, the locking pieces 15 are formed with a right-and-left pair of curved elastic pieces 19, 19, the regulating piece 16 is equipped with a back fitting face 20 which fits with the player's back, the angle indicating piece 17 comprises an arc-shape member 22 which is formed curved and installed on the opposite back fitting face 21 of the regulating piece 16, and the angle indicating bar 18 is formed so that it can display the inclination angle on the side face of the arc-shape member 22.

Also, as shown in FIG. 1, formed on the angle indicating piece 17 is an arc-shape slit 23 along the length direction.

As shown in FIG. 2, the posture correcting tool 11 of the present invention shown is constituted so that a golf player can wear it on his body when swinging, check whether the forward inclination angle of the player's upper-half body is appropriate or not, and immediately correct it if it is not appropriate.

It is grasped through the experience of the inventor of the present patent application that the optimal forward inclination angle of the player is a slope of 30~35 degrees center the hip joint relative to a vertical axis including the waist.

Namely, if the upper-half body is inclined forward by 30~35 degrees centering the hip joint from a vertical axis including the waist starting the waist, when the player swings, rotation of the upper-half body and shoulders, horizontal kinetic energy of the legs and waist, and vertical kinetic energy of the arms can be most efficiently transmitted to the ball without loss, extending the ball flight distance.

More precisely, if the waist is dropped over both legs with a balance, and the upper-half body is inclined forward by 30~35 degrees relative to a vertical axis line passing the waist on the hip joint when addressing, a line connecting the shoulder blade, the knee, and the backside of the big toe is formed as the result.

It has been disclosed that if a swing is performed in this state, a rotation axis generated by the body twisting when back swinging is firmly retained, and a posture is secured which can most efficiently transmit kinetic energy to the ball.

Hence, inclining the upper body forward precisely by 30~35 degrees becomes an indispensable element for efficient swings. The posture correcting tool 11 of the present embodiment example is for making it possible to easily master this forward inclination angle.

Conversely, if the forward inclination angle is smaller than the angle, the upper-half body stands up too much, and a slice will result if a ball is hit in such a state. On the other hand, if the forward inclination angle is larger than the angle, the upper-half body is bent too much, and a hook will result if a ball is hit in such a state.

Hence, it was disclosed in past studies that in either case, kinetic energy of the upper-half body twisting cannot be transmitted efficiently to the ball, which results in the hit ball deviating to the right or left and the flight distance not extending.

In this embodiment, as shown in FIG. 1, the posture correcting tool 11 is constituted having the wearing unit 12, the back fitting unit 13, and the angle indicating unit 14.

As shown in FIG. 2, the wearing unit 12 is constituted fixable to the player's waist. Namely, the wearing unit 12 has a locking piece 15 which can grab the player's waist as shown in FIG. 1 and FIG. 2.

Then, as shown in FIG. 1 and FIG. 2, the locking pieces 15 are formed with a right-and-left pair of curved elastic pieces 19 made of synthetic resin.

As shows in FIG. 1, the right-and-left pair of elastic pieces 19 is arranged in a left-and-right symmetry so that its plane shape becomes approximately circular, formed so that its inner diameter can be expanded by elastic deformation.

Also, as shown in FIG. 1, the front ends of the elastic pieces 19 are each bent outward to be easily attached to the waist, and an open section 25 which the body can penetrate is installed between the locking pieces 15 and 15.

Also, as shown in FIG. 1, connecting pieces 26 protruding backward are installed on the rear end of the elastic pieces 19, and the back fitting unit 13 and the angle indicating unit 14 are connected to those connecting pieces 26.

As shown in FIG. 1, the back fitting unit 13 is formed in a long plate shape of synthetic resin, and its lower end is sandwiched between the connecting pieces 26 in the wearing unit 12 and is rotatably joined with the wearing unit 12 by a joining member 32.

As shows in FIG. 2, the back fitting unit 13 is constituted so that it can regulate a specified forward inclination angle of the player's upper-half body so that kinetic energy can be most efficiently transmitted to a ball when a golf club impacts on the ball in order to extend the golf ball flight distance more precisely.

Namely, as shown in FIG. 1, the back fitting unit 13 is constituted of a regulating piece 16 which can fit with the player's back along its height direction when it is worn, wherein the regulating piece 16 is equipped with a back fitting face 20 which fits with the player's back.

Also, the angle indicating unit 14 is constituted so that it can visually check the forward inclination angle of the back fitting unit 13.

As shown in FIG. 1, the angle indicating unit 14 is constituted of an angle indicating piece 17 which is installed protruding in the opposite plane direction from the regulating piece 16, and an angle indicating bar 18. The angle indicating piece 17 comprises an arc-shape member 22 which is moderately curved downward.

Also, as shown in FIG. 1, formed on the angle indicating piece 17 is an arc-shape slit 23 along the length direction.

Also, as shown in FIG. 1, carved along the slit 23 on the side face of the angle indicating piece 17 is a scale 27 which displays the forward inclination angle of the back fitting face 20.

Scale 27 is attached over almost the whole range excluding the tip section in the length direction of the angle indicating piece 17, and the angle from the regulating piece 16 to the most outward scale is set to 30~35 degrees which is assumed to be the range of the forward inclination angle at which kinetic energy can be transmitted most efficiently to a ball when a golf club impacts on the ball in order to extend the golf ball flight distance more precisely.

Also, the angle indicating bar 18 is formed so that the angle can be displayed by sliding the side face of the arc-shape member 22.

As shown in FIG. 1, the angle indicating bar 18 has two pieces of plate section 29 and plate section 30 which are formed in a double-folded plate of synthetic resin which overlap with each other via a turning section 28 at the tips.

Then, formed between the plate section 29 and plate section 30 is a space 31 which is slightly larger than the plate thickness of the arc-shape member 22.

In the angle indicating bar 18 as shown in FIG. 1, the base ends of the plate section 29 and plate section 30 are overlapped on the outside of the connecting pieces 26 in the wearing unit 12 and rotatably fixed relative to the connecting pieces 26 by a joining member 32.

A screw 33 is used as the joining member 32, which can fix the angle indicating bar 18 rotatable relative to the wearing unit 12 to the back fitting unit 13.

Also, in the tip of the angle indicating bar 18 as shown in FIG. 1, the turning section 28 is placed covering the outside of the arch-shape member 22, fixed slidable in the length direction of the arch-shape member 22 by a joining member 24 comprising a screw 34.

Said joining member 24 penetrates the slit 23 on the arc-shape member 22 and is attached to be freely movable along the length direction of that slit 23.

Hence, the angle indicating bar 18 can be fixed to an arbitrary position of the angle indicating piece 17, and the regulating piece 16 can be let slide relative to the plate section 29 and plate section 30 via the joining member 32.

Also, a red indicator line 35 is attached to the center of the width direction of the angle indicating bar 18 along the length direction so that the user can easily recognize visually the standing state of the angle indicating bar 18.

Below is how to use the posture correcting tool 11 of this embodiment.

First, the optimal forward inclination angle of the player should be decided. As stated above, the forward inclination angle is selected as the forward inclination angle of the upper-half body in the range of 30~35 degrees centering the hip joint at which the player can twist smoothly centering the waist.

Afterwards, if 30 degrees is chosen as the forward inclination angle for example, the angle indicating bar 18 should be moved to a dial 27 indicating 30 degrees, and the tightening screws 33 and 34 at both ends of the angle indicating bar 18 should be tightened to fix the angle indicating bar 18.

Next, as shown in FIG. 2, keeping the angle indicating bar 18 fixed at the position showing the forward inclination angle of 30 degrees, the outer circumference of the waist should be grabbed by the locking pieces 15 of the wearing unit 12 to wear the posture correcting tool 11 on the body.

In this case, the open section 25 of the locking pieces 15 and 15 should proceed from the side of the body, be rotated by about 90 degrees and fixed on the back side. Hence, wearing it on the body can be easily performed irrespectively of the body shape.

As shown in FIG. 2, in addressing, the posture should be controlled the angle indicating bar 18 form a part of a vertical axis line X passing the waist. By this, the back fitting unit 13 becomes inclined forward by 30 degrees relative to the axis line X, and accordingly the upper-half body can be inclined forward by 30 degrees.

In this case, whether the player's forward inclination angle is optimal or not can be visually checked by the stand-up angle of the angle indicating bar 18, wherein the visual check can be performed with the red indicator line 35 attached to the angle indicating bar 18.

Namely, it is detected that if the angle indicating bar 18 is approximately vertical, the player's forward inclination angle is optimal, if the angle indicating bar 18 is inclined forward, the player is bent forward too much, and if the angle indicating bar 18 is inclined backward, the player's posture is standing too much, and the posture can be immediately corrected.

In this visual check, because the red indicator line 35 is attached to the angle indicating bar 18 along its length direction, the player can easily grasp the stand-up angle of the angle indicating bar 18 by looking at the indicator line 35.

In this way, in addressing, when the waist is dropped over both legs and the upper-half body is inclined forward by 30~35 degrees centering the hip joint relative to a vertical axis line passing the waist, a line connecting the shoulder blade, the knee, and the backside of the big toe is formed, and when a swing is performed in this state, a posture is secured which can most efficiently transmit kinetic energy produced by twisting the body in the back swing to the ball.

What is claimed is:

1. A posture correcting tool being worn when a player performs a swing practice comprising:

a wearing unit which can be fixed to the player's waist, a back fitting unit which is fixed to the wearing unit and arranged so that it can fit with the player's back when it is worn, and can regulate a forward inclination angle of the player's upper-half body when the player swings, and an angle indicating unit with which the forward inclination angle can be visually checked.

2. The posture correcting tool as claimed in claim 1, wherein the player is a golf player, comprising:

a wearing unit which can be fixed to the player's waist, a back fitting unit which is fixed to the wearing unit, is arranged so as to fit with the player's back when it is worn, and can regulate the forward inclination angle of the player's upper-half body when the player swings a golf club, and an angle indicating unit with which the forward inclination angle can be visually checked.

3. The posture correcting tool as claimed in claim 2, wherein the back fitting unit is constituted so as to regulate the specified forward inclination angle of the player's upper-half body so that kinetic energy can be transmitted to the ball most efficiently when the golf club impacts on the ball.

4. The posture correcting tool as claimed in claim 3, wherein the wearing unit has locking pieces which can grab the player's waist, the back fitting unit has a regulating piece which is fixed at about a right angle to the locking pieces and can fit with the player's back along the height direction of the player, and the angle indicating unit has an angle indicating piece which protrudes along a width direction to the regulating piece, and an angle indicating bar which is rotatably fixed to an end of the locking pieces, the angle indicating unit can display an angle on the angle indicating piece, and the bar can form a vertical axis passing the waist when it is worn.

5. The posture correcting tool as claimed in claim 4, wherein the locking pieces are formed with a right-and-left pair of curved elastic pieces, and the regulating piece is equipped with a back fitting face which fits with the player's back, and the angle indicating piece comprises an arc-shape member which is formed curved and installed on the opposite back fitting face of the regulating piece.

6. The posture correcting tool as claimed in claim 4, wherein the locking pieces comprise a pair of elastic pieces and is formed in a plane U-shape as the whole.

7. The posture correcting tool as claimed in claim 4, wherein the regulating piece and the arc-shape member are joined in a J-shape as the whole side face.

8. The posture correcting tool as claimed in claim 1, being constituted such that the forward inclination angle is 30~35 degrees centering the hip joint relative to a vertical axis line passing the waist.

* * * * *